US006971328B2

(12) United States Patent
Zarn

(10) Patent No.: US 6,971,328 B2
(45) Date of Patent: Dec. 6, 2005

(54) BOAT WITH RECESSED SHIFTER

(75) Inventor: Paul David Zarn, Henning, MN (US)

(73) Assignee: Lund Boat Company, Minneapolis, MN (US)

( * ) Notice: Subject to any disclaimer, the term of this patent is extended or adjusted under 35 U.S.C. 154(b) by 0 days.

(21) Appl. No.: 10/652,738

(22) Filed: Aug. 29, 2003

(65) Prior Publication Data

US 2005/0045087 A1 Mar. 3, 2005

(51) Int. Cl.[7] ..... B63B 17/00
(52) U.S. Cl. ..... 114/364; 440/84
(58) Field of Search ..... 114/364; 440/84, 440/87; 74/335

(56) References Cited

U.S. PATENT DOCUMENTS

| | | | | |
|---|---|---|---|---|
| 2,703,989 A | * | 3/1955 | Schroeder | 440/87 |
| 4,022,146 A | * | 5/1977 | Sadler | 440/84 |
| 4,200,055 A | * | 4/1980 | Siegel | 440/84 |
| 4,986,776 A | | 1/1991 | Hensel et al. | 440/87 |
| 5,967,867 A | * | 10/1999 | Rinzaki et al. | 440/87 |

OTHER PUBLICATIONS

"Gambler Bass Boats website pages," http://web.archive.org/web/20010519043733/http:// www.gambler-boats.com/, 9 pages (May 19, 2001).
"Get Where you want to go.," Sea-Doo Sport Boats, 23 pages (unknown).
"Still Building Legends . . . One at a Time.," Ranger Boats, pp. 1-84 (2003).
"Sugar Sand Showroom 2002," http://www.sugarsand.com/tango4/3.html, 2 pages (© 2001).
"Whatever You Do On The Water, Do It In A Crestliner," Crestliner Boats, 46 pages (2002).
"A Tradition Of Quality Lund Catalog," Lund Boat Company, pp. 1-58 (© 2001).

* cited by examiner

*Primary Examiner*—Lars A. Olson
(74) *Attorney, Agent, or Firm*—Malin, Haley & DiMaggio, P.A.

(57) ABSTRACT

A boat including a hull having a bow, a stern and first and second sides that extend between the bow and the stern. The boat also includes an interior sidewall that extends along at least a portion of the first side of the hull. A recess structure is defined by the interior sidewall. At least one shifter is mounted at the recess structure.

18 Claims, 3 Drawing Sheets

BOAT WITH RECESSED SHIFTER

TECHNICAL FIELD

The present invention relates generally to boats. More particularly, the present invention relates to throttle/shifter mounting configurations for boats.

BACKGROUND

A motor boat deck layout often includes a console for controlling operation of the boat. A typical console is positioned in a main cockpit area of the boat and includes a steering wheel coupled to a main motor of the boat by a conventional technique such as cables. A shifter is usually positioned near the console for allowing a driver of the boat to control the speed of the motor, and to shift the motor between forward, reverse and neutral. In a conventional configuration, the shifter is mounted to an interior sidewall (e. g. , a starboard interior sidewall) of the boat at a location adjacent to the driver's seat. As so positioned, the shifter projects into the main cockpit area thereby occupying valuable space.

SUMMARY

One aspect of the present disclosure relates to a shifter mounting configuration that provides for an improved deck layout and a more efficient use of space.

Another aspect of the present disclosure relates to a boat having a recessed pocket for mounting a shifter.

Still another aspect of the present disclosure relates to methods and configurations for recessing a shifter relative to a main occupiable interior space of a boat. Examples of a variety of inventive aspects in addition to those described above are set forth in the description that follows. It is to be understood that both the foregoing general description and the following detailed description are exemplary and explanatory only and are not restrictive of the broad inventive aspects that underlie the examples disclosed herein.

DETAILED DESCRIPTION

Figure 1:
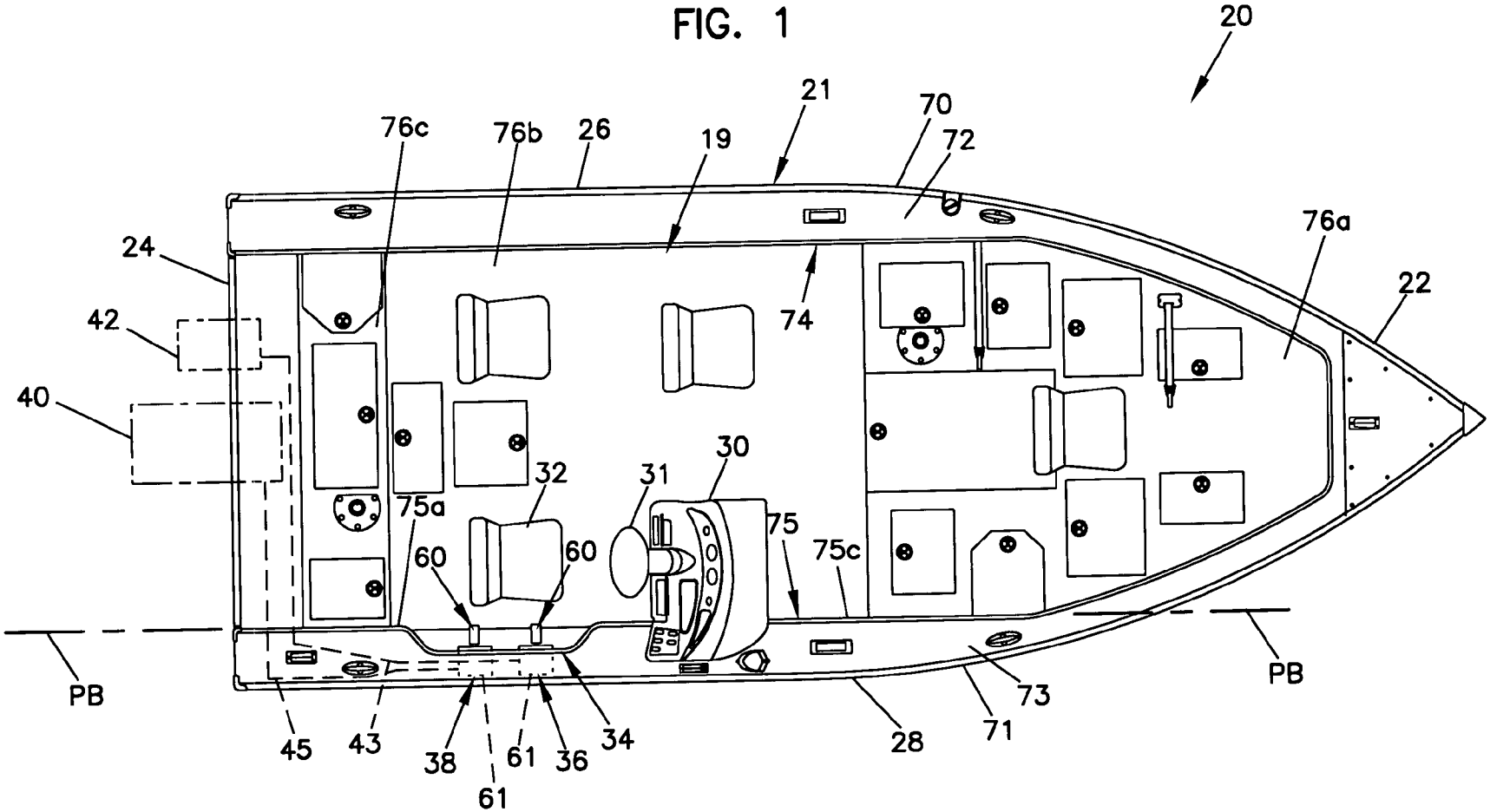
FIG. 1 is a top plan view of a boat having an example recessed shifter configuration.

FIG. 1 shows a boat 20 having features that are examples of inventive aspects in accordance with the principles of the present disclosure. The boat 20 includes a hull 21 having a bow 22 and a stern 24. The hull 21 also includes a port side 26 and a starboard side 28. The boat 20 further includes a cockpit 19 positioned generally at a midship region of the boat 20.

Referring still to FIG. 1, the boat 20 includes a steering console 30 positioned within the cockpit 19 adjacent the starboard side 28 of the boat 20. The steering console 30 includes a steering wheel 31 and other gauges and instrumentation for controlling operation of the boat. Example instrumentation includes a speedometer, fuel gauge, ignition switch, depth finder, live well actuators, temperature gauges or other structures. A driver's seat 32 is positioned aft of the steering console 30. A pocket 34 is located adjacent the starboard side of the driver's seat 32. First and second shifters 36, 38 are mounted at the pocket 34. The first shifter 36 controls a main motor 40 of the boat 20, and the second shifter 38 controls an auxiliary motor 42.

The shifters 36, 38 are shown coupled to their respective motors 40, 42 by cables 43, 45 as is conventionally known in the art. However, it will be appreciated that other coupling configurations such as other mechanical linkages, hydraulic couplings, electronic connections or remote connections could also be used. Further, in addition to shifting the motors between forward, reverse and neutral, it is preferred for the shifters 36, 38 to function as throttles for controlling the engine speeds of the motors 40, 42. As depicted in the drawings, the motors are outboard motors. In other embodiments, the motors could be inboard/outboard motors or inboard motors.

Figure 3:
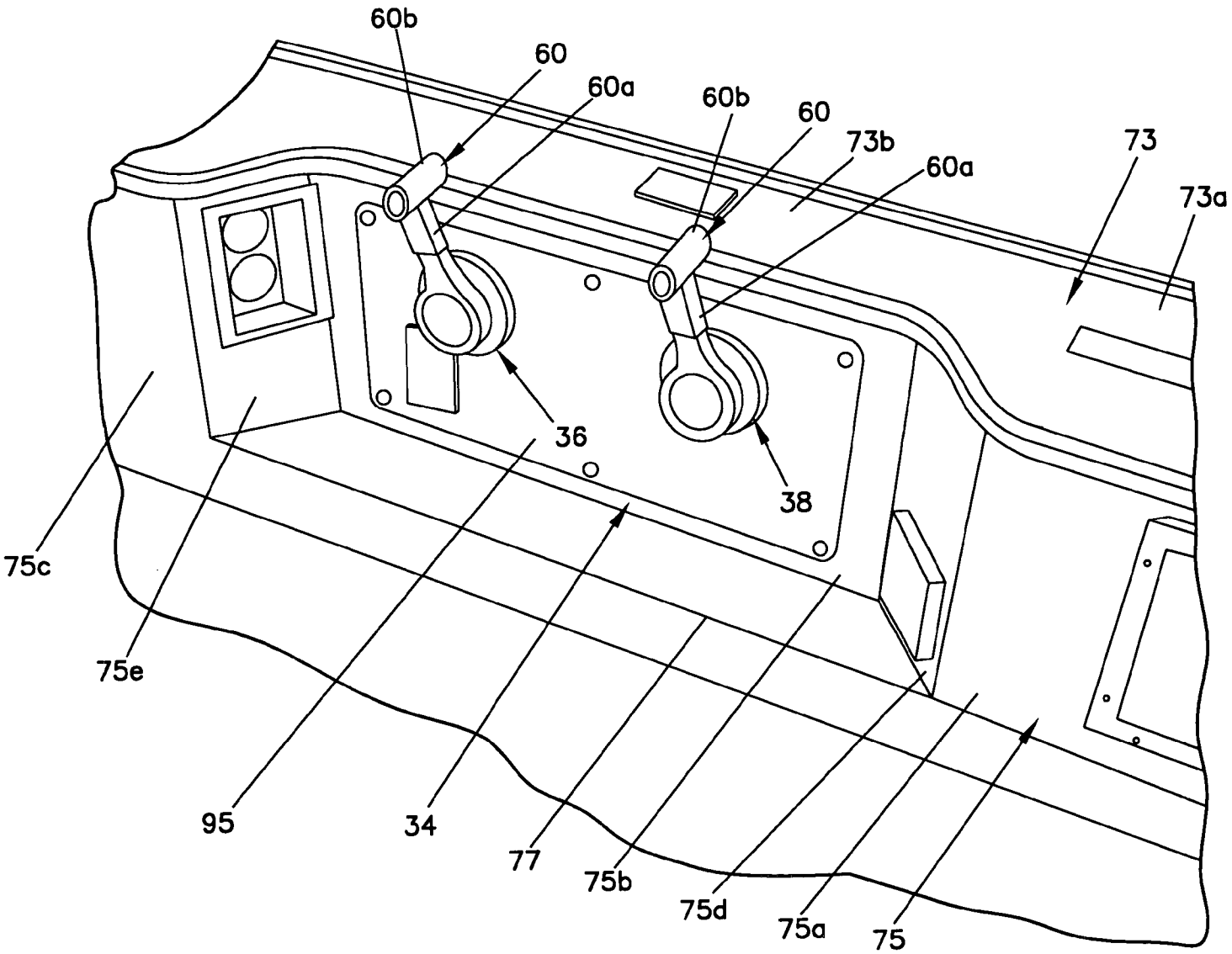
FIG. 3 is perspective view of the recessed shifter configuration of FIG. 1.

The shifters 36, 38 are of a conventional configuration and each includes a shifter arm 60 that is pivoted to shift the motors 40, 42 between forward, reverse, and neutral. As shown in FIG. 3, the shifter arms 60 each include a lever 60*a* and a top handle 60*b*. The term "handle" includes any type of structure that can be manually grasped. In the depicted embodiment, the handle 60*b* projects transversely outwardly from the lever 60*a*. In other embodiments, the handles could include other types of ergonomic gripping structures such as knobs, balls, finger grips, pistol grips or any other structure for facilitating grasping the lever 60*a*. In still other embodiments, the lever 60*a* itself can function as a handle without requiring any additional gripping structures.

Conventional shifter mechanisms within housings 61 (see FIG. 2) provide operative mechanical couplings between the arms 60 and the cables 43, 45. The shifters 36, 38 are mounted such that the housings 61 are hidden between an interior sidewall of the boat and the starboard side 28 of the boat 20.

Referring again to FIG. 1, the boat 20 includes port and starboard gunnels 70, 71 and port and starboard top decks 72 and 73 positioned adjacent the gunnels 70, 71. The gunnels 70, 71 and the top decks 72, 73 extend respectively along the port and starboard sides 26, 28 from the stern 24 to the bow 22. The boat 20 also includes port and starboard interior sidewalls 74 and 75 that extend generally vertically between the top decks 72, 73 and the floor of the boat. The floor includes a raised front casting platform 76*a*, a lowered cockpit pit region 76*b* and a raised rear casting platform 76*c*. The top decks 72, 73 each have a generally horizontal, planar configuration and are configured for allowing a user of the boat to step on the top decks 72, 73 to facilitate entering or exiting the boat 20. The top decks 72, 73 also provide mounting locations for structures such as cleats, lights, gas tank caps or other structures. The top decks can be referred to as weather boards, top panels or top members.

In the depicted embodiment, the hull 21 and the top decks 72, 73 have aluminum constructions. The top decks 72, 73 are joined to the hull 21 by the gunnels 70, 71. In certain embodiments, the gunnels 70, 71 can be extrusions having slots for receiving outer edges of the top decks 72, 73 and top edges of the port and starboard sides of the hull 21. The interior sidewalls 74, 75 extend in a generally vertical/upright direction from the floor of the boat 20 to the top decks 72, 73. The interior sidewalls 74, 75 can be secured to the top decks 72, 73 by an intermediate extrusion or any other type of fastening technique. In certain embodiments, the interior side walls can include aluminum panels covered with carpet on their interior side. While the depicted embodiment is constructed as an aluminum boat, it will be appreciated that the various inventive aspects disclosed herein are applicable to any type of boat having a shifter mounted adjacent to a sidewall of the boat regardless of whether the boat is aluminum, fiber reinforced resin, molded plastic or of any other construction.

Figure 2:
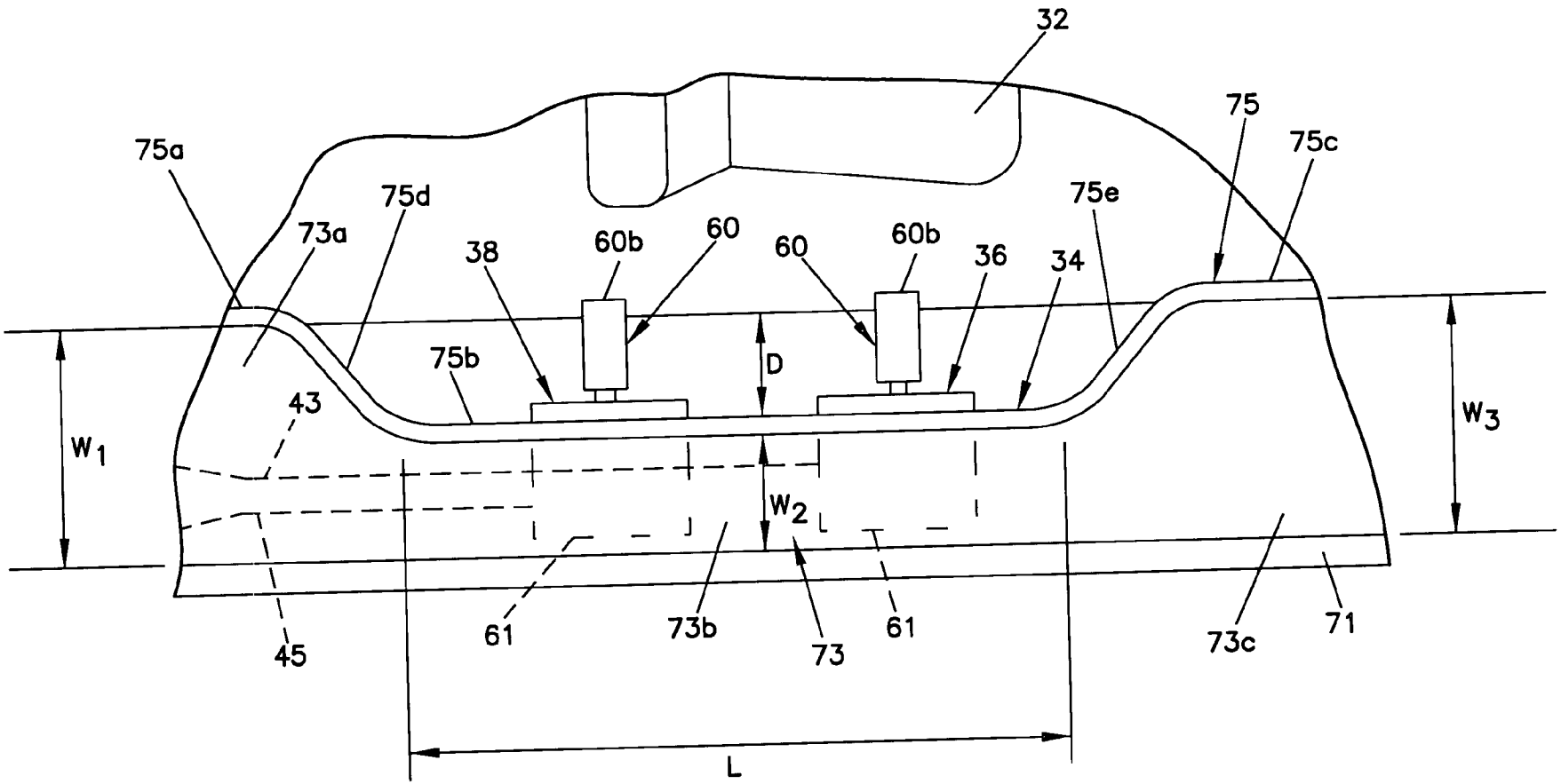
FIG. 2 is an enlarged view of the recessed shifter configuration of FIG. 1.

Referring to FIG. 2, the starboard top deck 73 includes a first section 73*a* positioned aft of the pocket 34, a second section 73*b* positioned adjacent to the pocket 34, and a third section 73*c* positioned in front of the pocket 34. The first section 73*a* has a first width $W_1$, the second section 73*b* has a second width $W_2$ and the third section 73*c* has a third width $W_3$. In the depicted embodiment, the width $W_2$ is less than the widths $W_1$ and $W_3$. In this embodiment, the widths $W_1$ and $W_3$ are equal to one another. However, it will be appreciated that in other embodiments the widths $W_1$ and $W_3$ can be different from one another. In one embodiment, the width $W_2$ is less than 70 percent of the widths $W_1$ and $W_3$. In another embodiment, the width $W_2$ is less than 60 percent of the widths $W_1$ and $W_3$. In still another embodiment, the width $W_2$ is less than or about equal to 50 percent of the widths $W_1$ and $W_3$. In one particular embodiment, the widths $W_1$ and $W_3$ are in the range of 7 to 12 inches, and the width $W_2$ is in the range of 3 to 6 inches. Preferably, the width $W_2$ is sufficiently large for the housings 61 of the shifters 36, 38 to fit between the interior sidewall 75 and the starboard side 28 of the hull 21. Widths outside of the ranges specified above can also be used.

The interior sidewall 75 includes a first section 75*a* corresponding to the first section 73*a* of the top deck 73, a second section 75*b* corresponding to the second section 73*b* of the top deck 73 and a third section 75*c* corresponding to the third section 73*c* of the top deck 73. The first, second, and third sections 75*a*, 75*b* and 75*c* are preferably arranged in a generally upright orientation with the second section 75*b* being recessed relative to the first and third sections 75*a*, 75*c*. The second section 75*b* is connected to the first section 75*a* by a rear offset section 75*d*, and the third section 75*c* is connected to the second section 75*b* by a forward offset section 75*e*. In the depicted embodiment, the rear offset section 75*d* is positioned aft of the driver's seat 32, while the forward offset section 75*e* is positioned in front of the driver's seat 32. The second section 75*b* can include a control panel 95 (see FIG. 3) to which the shifters 36, 38 are mounted. The control panel 95 is removable to provide access to the shifters for maintenance, repair, ease of assembly, or other reasons.

As shown in FIG. 2, the second section 75*b* preferably has a length L that is sufficiently long to allow at least two shifters to be mounted thereto. For the depicted embodiment, the length L is preferably in the range of 20–30 inches, most preferably about 26 inches. For a single shifter embodiment, the length can be in the range of 10–15 inches. It will be appreciated that the length can be varied from the dimensions specified above to accommodate different shifter styles.

The rear offset section 75*d* preferably extends in a generally upright direction and is aligned at oblique angles with respect to the first and second sections 75*a*, 75*b*. The forward offset section 75*e* is also aligned in a generally upright orientation, and is aligned at oblique angles with respect to the second and third sections 75*b*, 75*c* of the interior sidewall 75.

The second section 75*b* as well as the offset sections 75*d* and 75*e* cooperate to define the recessed pocket 34 in which the shifters 36, 38 are mounted. The shifters 36, 38 are mounted to the control panel 95 that forms a part of the second section 75*b*. In one embodiment, the pocket 34 has a depth D that is in the range of 3 to 7 inches. In other embodiments, the depth D can be greater than 0 inches, or greater than 1 inch, or in the range of 1–8 inches. In the depicted embodiment, the depth D is about 5 inches. Of course, the depth will vary dependent upon cockpit layout, hull deadrise angle, the type of shifter used or other factors.

As shown in FIG. 3, the bottom of the pocket 34 is closed by a raised shelf portion 77 that is stepped above the main floor 76*b* of the cockpit. The topside of the pocket 34 is preferably open such that the handles 60*b* of shifter arms 60 can project upwardly through the open topside of the pocket to a position higher than the top deck 73 to facilitate access to the handles 60*b*. In other embodiments, the arms 60 may not project above the top deck, or the topside of the pocket may be blocked or closed.

The depicted pocket 34 is shown bound on four sides. For example, the front side is bound by section 75*e*, the rear side is bound by section 75*d*, the outer side is bound by section 75*b* and the bottom side is bound by portion 77. The top and inner sides of the pocket 34 are open to facilitate access to the shifter arms 60. In other embodiments, the shifter arms 60 need not be enclosed on front and back sides. For example, in other embodiments, the width W3 can be equal to the width W2 such that section 75*b* is recessed relative to rear wall section 75*a* but not front wall section 75*c*. The terms "inner" and "outer" are defined with reference to a keel line of the boat. Thus, the "inner" side of the pocket is closer to the keel line than the outer side of the pocket.

The first and third interior wall sections 75*a*, 75*c* define a primary boundary PB (see FIG. 1) that extends along the starboard side of the main cockpit area 19 of the boat. The primary boundary PB defines a main interior region of the cockpit that can be occupied by a passenger. The primary boundary PB extends across the open side of the pocket 34. The depth D of the pocket 34, measured from the open side to the closed side of the pocket, can be selected so that the arms 60 of the shifters 36, 38 do not project inwardly beyond the primary boundary PB. However, in other embodiments, portions of the shifter arms 60 can project beyond the primary boundary PB. In certain embodiments, at least a portion of each shifter arm is recessed relative to the primary boundary PB. In other embodiments, a majority of the length of each handle 60*a*, 60*b* is recessed relative to the primary boundary PB.

The present invention relates generally to structures for recessing a shifter relative to an interior area of a boat. The present invention also relates to structures for recessing a boat shifter to provide for more efficient use of interior boat space and/or to improve the ergonomic location of the shifter. Example terms descriptive of structures for recessing a shifter include pockets, holes, recesses, nooks, recessed regions, offset regions, chambers, cavities, concavities or receptacles.

As shown in FIG. 1, the seat 32 is positioned laterally adjacent to the pocket 34 with a centerline of the seat 32 aligned with the center of the steering wheel. The recessed configuration of the shifters also allows the seat 32 to be pivoted 360° about its vertical mounting post without encountering interference from the shifters.

With regard to the foregoing description, changes may be made in detail, especially with regard to the shape, size and arrangement of the parts. For example, while dimensions have been specified for certain embodiments, other embodiments within the scope of the present disclosure can include dimensions outside of those specifically recited. It will be appreciated that the dimensions will typically be dependent on the type of shifter used. It is intended that the specification and depicted aspects be considered illustrative only and not limiting with respect to the broad underlying concepts of the present disclosure.

I claim:

1. A boat comprising:

a hull including a bow, a stern and first and second sides that extend between the bow and the stern;

a top deck that extends along the first side of the hull;

an interior sidewall that extends along at least a portion of the top deck;

a pocket defined by the interior sidewall;

the top deck including a first width rearward of the pocket, a second width adjacent to the pocket, and a third width forward of the pocket, the second width being smaller than the first and third widths;

at least one shifter mounted at the pocket;

wherein the interior sidewall defines a primary boundary along one side of a cockpit of the boat, wherein the pocket includes a recessed side that is recessed relative to the primary boundary and an open side located at the primary boundary, and wherein the shifter is mounted to the recessed side; and wherein the interior sidewall includes a rearward section positioned aft of the pocket, and a forward section positioned in front of the pocket, the rearward and forward sections being positioned in a generally upright orientation.

2. The boat of claim 1, wherein the first and third widths are equal to one another.

3. The boat of claim 1, wherein the shifter includes a shifter arm that extends upwardly through an open upper region of the pocket so as to extend above the top deck.

4. The boat of claim 1, wherein the pocket is sized to allow at least two shifters to be mounted at the pocket.

5. The boat of claim 4, wherein two shifters are mounted at the pocket.

6. The boat of claim 1, wherein the second width is less than 60 percent as large as the first and third widths.

7. The boat of claim 1, wherein the pocket includes a rearward offset portion that extends between the recessed side of the pocket and the rearward section of the interior wall, and a forward offset portion that extends between the recessed side of the pocket and the forward section of the interior wall.

8. The boat of claim 7, wherein the front offset portion is aligned at an oblique angle relative to the forward section of the interior wall and the recessed side of the pocket, and the rear offset portion is aligned at an oblique angle relative to the rearward section of the interior wall and the recessed side of the pocket.

9. The boat of claim 8, further comprising a steering console and a driver's seat, the front offset portion being located rearward of the console and forward of the driver's seat, and the rear offset portion being located rearward of the driver's seat.

10. The boat of claim 9, wherein the shifter includes a shifter arm that is at least partially recessed relative to the primary boundary.

11. The boat of claim 10, wherein the shifter arm includes a top handle having a length that extends in a direction between the recessed side of the pocket and the primary boundary, a majority of the length of the handle being recessed relative to the primary boundary.

12. The boat of claim 1, wherein the shifter includes a shifter arm that is at least partially recessed relative to a boundary that defines an occupiable interior space of the boat.

13. The boat of claim 12, wherein a majority of the shifter arm is recessed relative to the boundary.

14. The boat of claim 12, wherein a portion of the shifter arm extends upwardly through an open topside of the pocket.

15. A boat comprising:

a hull having a bow, a stern and first and second sides that extend between the bow and the stern;

an interior wall that extends along at least a portion of the first side of the hull, the interior wall including a generally upright first section and a generally upright second section that is recessed relative to the first section;

wherein the second upright section includes a reinforcing panel to which a shifter is mounted; and at least one shifter mounted to the second section, the shifter including a shifter arm at least partially recessed relative to the first upright section.

16. The boat of claim 15, wherein the first upright section is located aft of the second upright section, wherein a third upright section is located in front of the second upright section, and wherein the second upright section is recessed relative to both the first and third upright sections.

17. The boat of claim 16, wherein the interior sidewall includes a rearward offset section that extends between the first upright section and the second upright section and a forward offset, section that extends between the second upright section and the third upright section.

18. The boat of claim 18, wherein the rear offset section is aligned at oblique angles relative to the first and second upright sections, and the forward offset section is aligned at oblique angles relative to the second and third upright sections.

* * * * *